US009033749B2

(12) United States Patent
Seberger

(10) Patent No.: US 9,033,749 B2
(45) Date of Patent: May 19, 2015

(54) ELECTRICAL TERMINAL HAVING A HOUSING WITH A WIRE CLAMP TO SECURE A WIRE TO A CONNECTOR PIN

(71) Applicant: Fisher Controls International LLC, Marshalltown, IA (US)

(72) Inventor: Stephen George Seberger, Marshalltown, IA (US)

(73) Assignee: FISHER CONTROLS INTERNATIONAL, LLC, Marshalltown, IA (US)

( * ) Notice: Subject to any disclaimer, the term of this patent is extended or adjusted under 35 U.S.C. 154(b) by 35 days.

(21) Appl. No.: 13/644,884

(22) Filed: Oct. 4, 2012

(65) Prior Publication Data

US 2013/0090024 A1 Apr. 11, 2013

Related U.S. Application Data

(60) Provisional application No. 61/544,084, filed on Oct. 6, 2011.

(51) Int. Cl.

| | |
|---|---|
| ***H01R 11/22*** | (2006.01) |
| ***H01R 4/48*** | (2006.01) |
| ***H01R 13/187*** | (2006.01) |
| ***H01R 12/58*** | (2011.01) |
| ***H01R 43/02*** | (2006.01) |
| *H01R 13/504* | (2006.01) |
| *H01R 13/52* | (2006.01) |
| *H01R 12/50* | (2011.01) |

(52) U.S. Cl.

CPC ..... *H01R 4/48* (2013.01); *H01R 13/187* (2013.01); *H01R 12/585* (2013.01); *H01R 13/504* (2013.01); *H01R 13/5202* (2013.01); *H01R 13/521* (2013.01); *H01R 23/688* (2013.01); *H01R 43/0256* (2013.01)

(58) Field of Classification Search

USPC ..... 439/851, 417, 441, 418, 397

See application file for complete search history.

(56) References Cited

U.S. PATENT DOCUMENTS

| | | | | |
|---|---|---|---|---|
| 4,401,353 | A * | 8/1983 | McDevitt et al. | 439/189 |
| 4,533,188 | A | 8/1985 | Miniet | |
| 4,759,726 | A * | 7/1988 | Naylor et al. | 439/441 |
| 4,921,439 | A | 5/1990 | Bofill et al. | |
| 4,981,432 | A * | 1/1991 | Kikuchi | 439/417 |
| 6,428,343 | B1 | 8/2002 | Landis et al. | |
| 6,965,671 | B2 * | 11/2005 | Kao et al. | 379/438 |
| 2008/0045065 | A1 | 2/2008 | O'Connor | |
| 2011/0086525 | A1 | 4/2011 | Begemann et al. | |

OTHER PUBLICATIONS

PCT, "Search Report," issued in connection with International Patent Application No. PCT/US2012/059215, dated Jan. 2, 2013 (3 pages).

PCT, "Written Opinion," issued in connection with International Patent Application No. PCT/US2012/059215, dated Jan. 2, 2013 (7 pages).

* cited by examiner

*Primary Examiner* — Chandrika Prasad

(74) *Attorney, Agent, or Firm* — Hanley, Flight and Zimmerman, LLC

(57) ABSTRACT

Electrical terminals and methods of manufacturing the same are disclosed. An example terminal is disclosed that comprises a housing and a wire clamp positioned within the housing to secure a wire in electrical contact with a connector pin, the connector pin extending out a bottom surface of the housing to be electrically connected to a printed circuit board, the housing is to have one or more feet to separate the bottom surface of the housing from the printed circuit board.

21 Claims, 5 Drawing Sheets

ELECTRICAL TERMINAL HAVING A HOUSING WITH A WIRE CLAMP TO SECURE A WIRE TO A CONNECTOR PIN

RELATED APPLICATION

This patent claims the benefit of provisional application Ser. No. 61/544,084, which was filed on Oct. 6, 2011, and which is incorporated herein by reference in its entirety.

FIELD OF THE DISCLOSURE

This disclosure relates generally to electrical connectors and, more particularly, to electrical terminals and methods of manufacturing the same.

BACKGROUND

Electrical terminal blocks or just terminals are electrical connectors that facilitate the connecting of individual electrical wires to other wires and/or external circuits. Terminals are used widely in many industries because of their versatility in connecting various sizes, types (e.g., solid-core vs. stranded wire), and/or number of wires. There are many different terminal designs that may be used to securely hold and establish an electrical connection to a wire. For example, some terminals may accept wires prepared with ring or spade terminal lugs on their ends. Other terminals may secure the stripped end of a wire with a metal clamp that is manually actuated by a screw. Yet other terminals may clamp a wire in place via a spring force that may be actuated manually or automatically.

There are also differing methods to connect one terminal to another and/or to external circuits. For example, multiple terminals may be mounted to a common base (e.g., a DIN rail) to secure the terminals relative to one another and then connected with various connecting pieces (e.g., bridge bars) designed to engage and connect individual terminals. Other terminals are designed to mount directly to a printed circuit board via pins soldered directly into the printed circuit board to establish the desired electrical connection(s).

SUMMARY

Electrical terminals and methods of manufacturing the same are disclosed. An example terminal comprises a housing and a wire clamp positioned within the housing to secure a wire in electrical contact with a connector pin, the connector pin extending out a bottom surface of the housing to be electrically connected to a printed circuit board, the housing is to have one or more feet to separate the bottom surface of the housing from the printed circuit board.

Another example terminal comprises a body having an opening to receive an end of a wire, a wire holder within the body to secure the end of the wire, a connector pin extending out a bottom surface of the body to be electrically connected to a circuit board, where the wire holder is to secure the end of the wire in electrical connection with the connector pin, the body comprises a spacer extending out the bottom surface of the body adjacent the connector pin to provide a space between the bottom surface of the body and the circuit board.

Another example terminal comprises a housing having an opening to receive an end of a wire, a first connector pin extending out from a bottom surface of the housing via a hole in the bottom surface of the housing, the connector pin to connect to a circuit board via a solder joint, a first clamp enclosed by the housing to secure the end of the wire in electrical contact with the first connector pin, and a riser extending from the bottom surface of the housing to raise the bottom surface of the housing away from the circuit board to enable access beneath the housing around the solder joint.

DETAILED DESCRIPTION

Figure 1A:
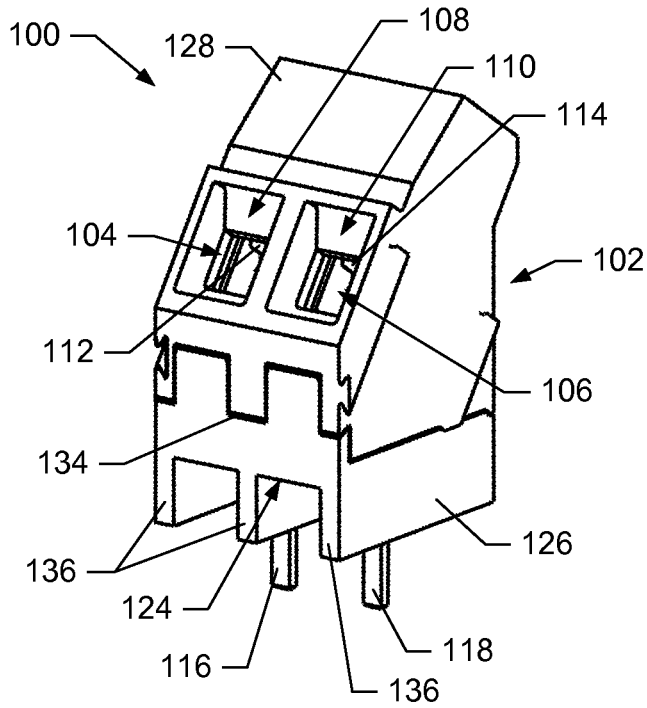
FIG. 1A is an isometric diagram of an example two-wire terminal in accordance with the teachings disclosed herein.
Figure 1B:
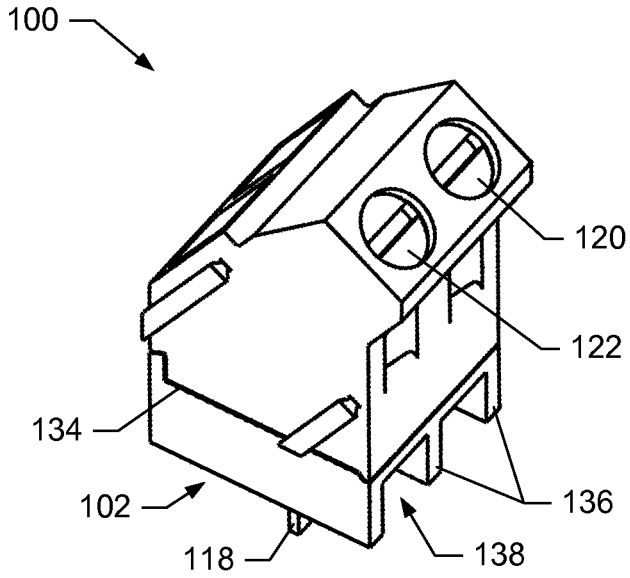
FIG. 1B is an isometric diagram of a different angle of the example terminal of FIG. 1A.
Figure 1D:
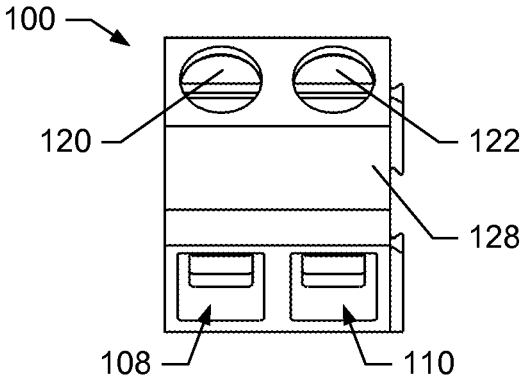
FIG. 1D is a top view of the example terminal of FIG. 1A.
Figure 1C:
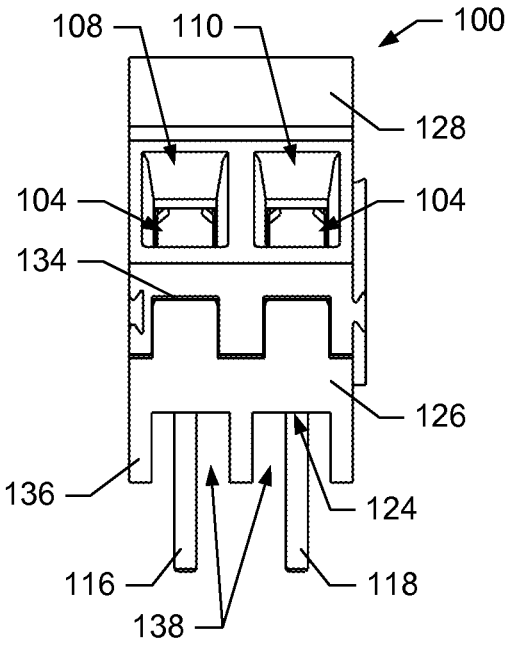
FIG. 1C is a front view of the example terminal of FIG. 1A.
Figure 1F:
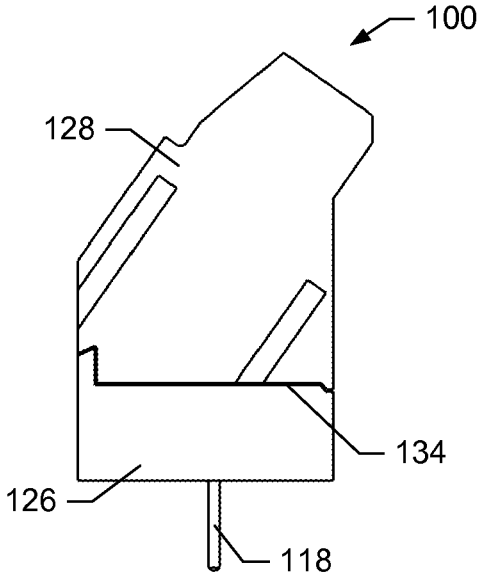
FIG. 1F is a side view of the example terminal of FIG. 1A.
Figure 1E:
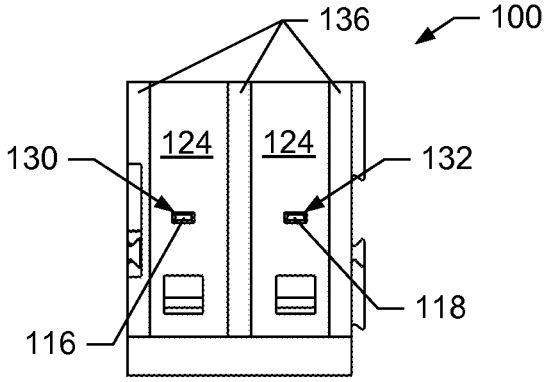
FIG. 1E is a bottom view of the example terminal of FIG. 1A.

FIGS. 1A and 1B are isometric diagrams of an example two-wire terminal 100. FIGS. 1C-1F are diagrams of front, top, bottom, and side views, respectively, of the terminal 100. In some examples, the terminal 100 has a plastic body or housing 102 to enclose internal mechanisms that enable an end of a wire to be connected with other electrical components (e.g., other terminals, a printed circuit board, etc.). For example, the internal mechanism of a terminal may include a wire holder such as a clamp, cage, spring, etc, to hold a wire in place and maintain the wire in electrical contact with an electrical lead or pin that can be electrically connected with the other electrical components.

A terminal may be constructed to enable the connection of one or more wires. For example, as shown in the illustrated examples, the terminal 100 has two wire entry points, apertures, or openings 104, 106, corresponding to two separate wire termination points 108, 110 for two separate wires. Each wire position 108, 110 may contain a corresponding internal mechanism to receive a bare end of a wire and secure it to be electrically connected to other components connected with the terminal 100. In particular, the illustrated examples in FIGS. 1A-1F are representative of an example cage clamp terminal but other types of terminals may be suitably adapted in accordance with the teachings disclosed herein. Accordingly, as illustrated in FIGS. 1A-1F, each internal mechanism of the example terminal 100 contains a corresponding cage 112, 114 enclosed within the housing 102 to receive and clamp a corresponding end of a wire in electrical contact with a corresponding metal surface that is electrically connected to a corresponding connector pin 116, 118. In such examples, each cage 112, 114 is actuated by a corresponding screw 120, 122. In some examples, the connector pin 116, 118 extends away from a bottom surface 124 of the housing 102 and may be electrically connected to other electrical components such as, for example, by soldering the protruding end of the connector pins 116, 118 to a printed circuit board.

Unlike many known cage clamp terminal bodies or housings, which are formed from a single piece of material (i.e., are unitary) and which have an opening in the bottom to insert the internal mechanisms, the housing 102 of the example terminal 100 is made of a base or bottom portion 126 and a separate cap or top portion 128. The base portion 126 includes holes 130, 132 in the bottom surface 124 through which the pins 116, 118 may be inserted. Other than the holes 130, 132, the base portion 126 is closed off on the bottom surface 124. In some examples, each hole 130, 132 is substantially fitted (e.g., sized for a press-fit) to the respective connector pin 116, 118 to reduce the possibility of external materials entering the housing 102 via the bottom of the housing 102 and causing an electrical leakage path.

After the internal mechanisms (e.g., the cages 112, 114) are inserted into the base portion 126 with the connector pins 116, 118 extending out through the holes 130, 132, the top portion 128 is placed on the base portion 126 over the internal mechanisms. In the illustrated examples, the base and top portions 126, 128 are shaped to securely mate with each other along a seam 134, thereby completely enclosing the internal mechanisms of the example terminal 100. In some examples, the base and top portions 126, 128 may be sealingly mated along the seam 134 via ultrasonic welding to bond the base and top portions 126, 128 and achieve a tight seal around the internal mechanisms of the terminal 100. In this manner, the potential for contaminants from an external environment ingressing, via the interfacing surfaces of the base and top portions 126, 128, and disrupting the electrical connections established via the terminal 100 is reduced. Additionally or alternatively, a tight seal may be accomplished via an over-molding process, in which a separate piece is attached with an adhesive and/or a sealant and/or via any other suitable method.

In addition to a sealing joint along the seam 134 around the exterior of the housing 102, in some examples, the mated base and top portions 126, 128 form an internal wall that extends between the wire termination points 108, 110. In this way, the internal mechanisms (e.g., the cages 112, 114) of the example terminal 100 may not only be substantially isolated from an outside environment (and any associated contaminants) surrounding the bottom and/or sides of the housing 102, but each internal mechanism may also be isolated from the other internal mechanisms. The separation of the internal mechanisms serves to reduce (e.g., prevent) the potential for corrosion and/or an electrical leakage path from developing between the two wire termination points 108, 110 from trapped moisture and/or contaminants resulting in an undesirable and/or unexpected electrical connection. As described above, the bonding of the base and top portions 126, 128 to form the internal wall may be accomplished via ultrasonic welding, an adhesive, and/or any other suitable method.

Furthermore, in some examples, the terminal 100 may include one or more feet, risers, or spacers 136 extending from the bottom surface 124 of the housing 102 to raise the terminal 100 and provide a space or gap 138 between the bottom surface 124 of the terminal 100 and a printed circuit board (not shown) to which the connector pins 116, 118 may be soldered. In such examples, the gap 138 enables access to the solder joints to encapsulate the printed circuit board including the solder joints to achieve environmental exclusion. Additionally, such an encapsulation process may be performed without concern for the encapsulant entering the housing 102 of the terminal 100 and potentially affecting the internal mechanisms because the bottom surface 124 of the housing 102 is closed except for where the connector pins 116, 118 extend through the holes 130, 132 of the bottom surface 124. Furthermore, the holes 130, 132 may be sized to provide a tight fit (e.g., a press-fit, an interference fit, etc.) around the connector pins 116, 118 to reduce the possibility of encapsulant (or other contaminants) around the bottom of the housing 102 from entering the terminal 100, especially where the encapsulant has a high viscosity. In addition, an over-molding process would achieve an even tighter seal between the connector pins 116, 118 and the holes 130, 132.

Additionally or alternatively, the gap 138 created by the feet 136, in the illustrated example, also enables access to the solder joints for more effective cleaning, thereby reducing the chance of accumulation of contaminants and/or corrosion. As a result, the example terminal 100 may last significantly longer without replacement and/or provide substantially increased reliability and/or may be used in less benign environments (e.g., corrosive atmospheres and/or high temperature and humid environments) than many known terminal blocks. Additionally, even when cleaning is not frequently performed, the feet 136 of the illustrated example may also serve as a wall to at least partially isolate the adjacent connector pins 116, 118 from each other, thereby reducing the possibility of an electrical leakage path developing between the pins 116, 118 from moisture and/or contamination build up. Similarly, the example feet 136 may also serve as a wall to separate the connector pins 116, 118 from other adjacent circuitry (e.g., circuitry on a printed circuit board).

While the feet 136 are shown in the illustrated examples of FIGS. 1A-1F as being rectangular, the feet 136 may be circular or have any other suitable cross-section. Similarly, while the example feet 136 shown in FIGS. 1A-1F are straight, the feet 136 may be curved, joined at one end, or positioned in any other suitable manner in accordance with the teachings of this disclosure. Furthermore, the height of the feet 136 (and, therefore, the height of the gap 138) may be of any suitable dimension.

Figure 2:
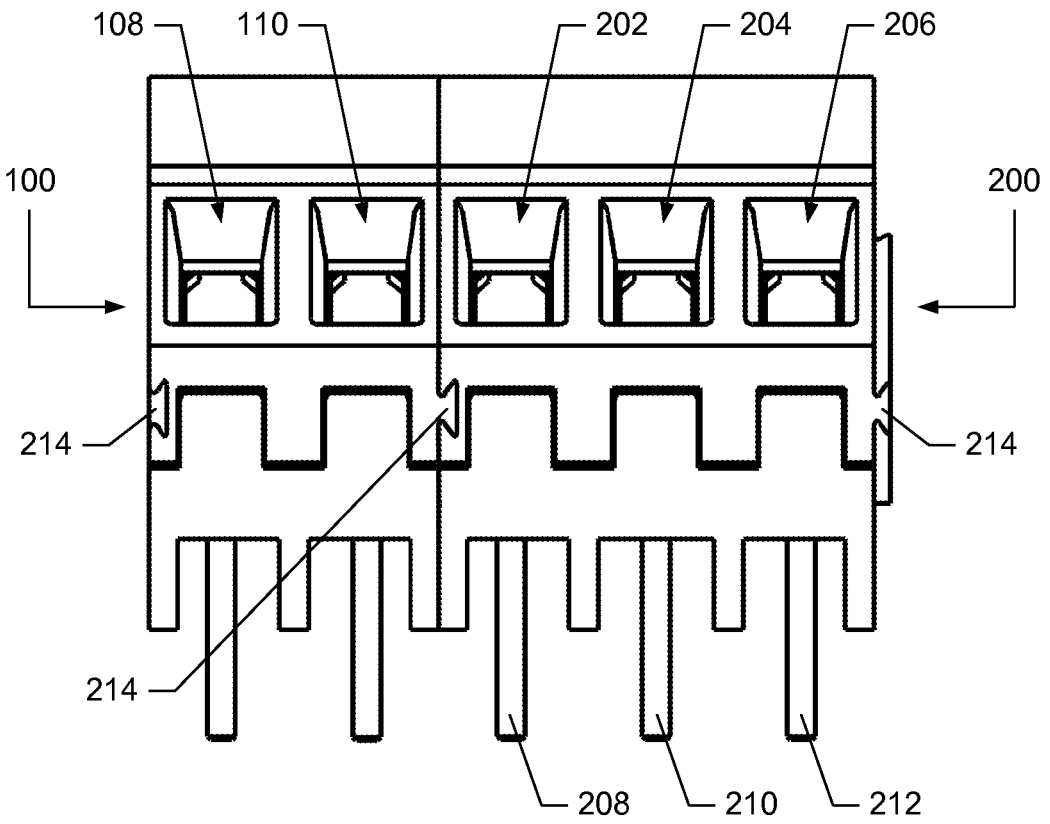
FIG. 2 is a schematic diagram of an example three-wire terminal mated with the example two-wire terminal of FIG. 1A.

FIG. 2 is a schematic diagram of an example three-wire terminal 200 mated with the example terminal 100 of FIG. 1A. The example three-wire terminal 200 is similar in design and function as the example two-wire terminal 100 discussed above in connection with FIGS. 1A-1F. However, the three-wire terminal 200 has three wire termination points 202, 204, 206 and three corresponding internal mechanisms (e.g., cages) connected to respective connector pins 208, 210, 212 rather than the two wire termination points 108, 110 in the two-wire terminal 100. In the illustrated example, the terminals 100, 200 are mated via bracket connectors 214 (e.g., dove-tail type connectors) formed on either side of the terminals 100, 200. In this manner, any suitable number of wire termination points may be aligned using any suitable number of terminals. Furthermore, while multiple terminals (e.g., the example terminals 100, 200) may be mated side-by-side, in other examples, a single terminal may be formed in accordance with the teachings disclosed herein comprising any suitable number of wire termination points, including terminals with only a single wire position.

In addition to the number of wire termination points 108, 110, 202, 204, 206, a terminal constructed in accordance with the teachings disclosed herein may vary in other respects as well. For example, the angle of the screws 120, 122 and wire entry points 104, 106 can be varied relative to one another and/or relative to the surface of the printed circuit board. The dimensions and/or size of the terminals and corresponding components may be appropriately varied. Furthermore, as previously stated, the feet 136 as well as the two-part body 102 to enclose the internal mechanisms of a terminal may be incorporated into different types of terminals other than cage clamp terminals.

Figure 3:
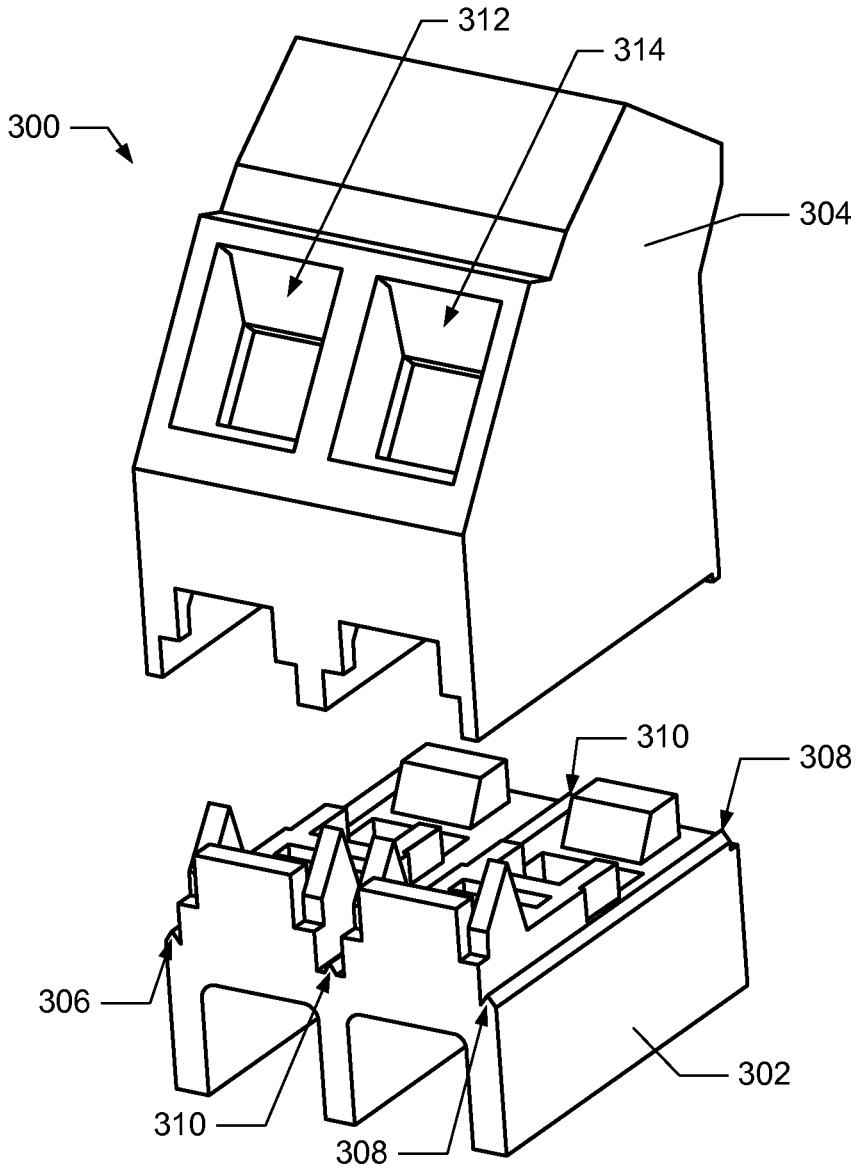
FIG. 3 is an exploded view of an example housing for another example two-wire terminal according to the teachings disclosed herein.

FIG. 3 is an exploded view of an example housing 300 of an example two-wire terminal having a base portion 302 and a top portion 304 similar to the housing 102 of the example terminal 100 described above in connection with FIGS. 1A-F. As shown in the illustrated example of FIG. 3, the base portion 302 includes triangular shaped weld lines 306, 308 along portions of the perimeter of the base portion 302. In the illustrated example, the weld lines 306, 308 provide excess plastic that may be melted during an ultrasonic welding process to bond the base portion 302 to the top portion 304 and form a seal around the internal mechanisms to be enclosed within the housing 300. While the weld lines 306, 308 are shown spanning opposites sides of the base portion 302, other weld lines may be located at other locations along the perimeter of the base portion 302 to achieve the desired sealing bond when the base and top portions 302, 304 are mated. Furthermore, the illustrated example of FIG. 3 shows another weld line 310 spanning the center of the base portion 302. In this manner, when the base and top portions 302, 304 of the example housing 300 are mated during the ultrasonic welding process, they may form an internal wall that is tightly sealed between the internal mechanisms for each of two wire termination points 312, 314 illustrated in FIG. 3. In other examples, additional weld lines may be placed on the top portion 304 instead of, or in addition to, the weld lines 306, 308, 310 located on the base portion 302.

Figure 4:
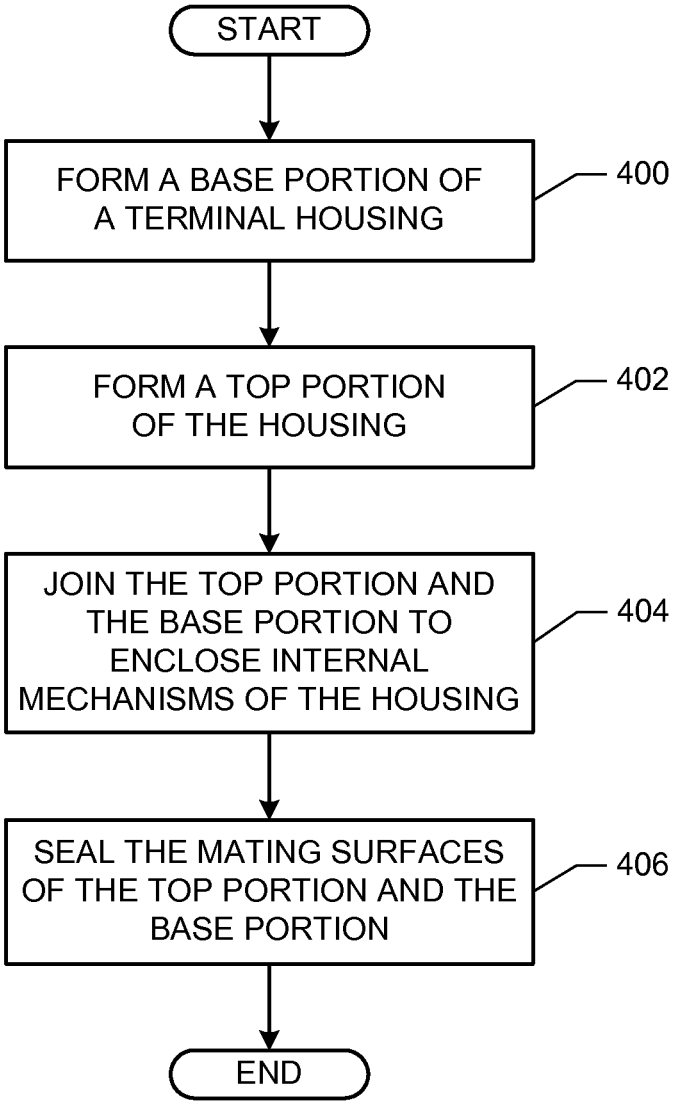
FIG. 4 is a flow chart representative of an example process that may be carried out to manufacture the example electrical terminals described herein.

FIG. 4 is a flowchart representative of an example process to manufacture any of the example electrical terminals disclosed herein. Although the example process of FIG. 4 is described with reference to the flowchart of FIG. 4, many other methods of implementing the example process of FIG. 4 may be employed. For example, the order of execution of certain blocks may be changed, and/or some of the blocks described may be changed, eliminated, sub-divided, or combined.

The example process of FIG. 4 begins by forming a base portion of a terminal housing (block 400). The base portion may be made of plastic and, therefore, formed via an injection molding process or any other suitable method. The shape of the base portion may be formed so as to hold internal mechanisms (e.g., clamp, cage, spring, etc.) within the terminal. As described above, the internal mechanisms may be employed to secure a wire in electrical connection with corresponding connector pins, which may be used to then electrically connect the wire to other electrical components (e.g., a printed circuit board). In some examples, the base portion is formed with a closed off bottom surface except for holes through which the connector pins may extend.

The example process of FIG. 4 further includes forming a top portion of the terminal housing (block 402). The top portion may be formed in a similar manner to the base portion such that the shape of the top portion fits over the internal mechanism and may be mated with the base portion. In this manner, the top and base portions of the terminal housing may enclose the internal mechanisms. Although surrounding the internal mechanisms, the top portion may contain an opening or aperture through which an end of wire may be fed and received by the internal mechanisms. In some examples, the terminal is to include more than one wire termination points. In such examples, both the base portion and the top portion may be formed such that when they are joined around the internal mechanisms, the base and top portions form an internal wall separating each internal mechanism corresponding to each wire termination point.

With the base and top portions thus formed, the example process then joins the base and top portion to enclose the internal mechanisms (block 404). Additionally, the example process involves sealing the mating surface of the top portion and the base portion (block 406). In some examples, the sealing process may include ultrasonic welding. In such examples, when the base portion and/or the top portion are formed (blocks 400, 402), the mating surfaces may include one or more weld lines defined by an excess portion of plastic to be melted and provide a tight seal between the top and base portions. Such an example may apply to the exterior perimeter of the terminal or to an internal wall when there is more than one wire termination point. The seal along the perimeter of the terminal helps to reduce the chance for contaminants, moisture, or encapsulant from the outside environment from entering the housing through the interface between the base and top portions while the seal along an internal wall serves to reduce the possibility of corrosion and/or an electrical leakage path from developing between adjacent internal mechanisms. Additionally or alternatively, the base portion and the top portion may be sealed (block 406) via any other suitable process such as an over-molding process, an adhesive, a sealant, etc. Once the base portion and the top portion have been sealingly mated, the example process of FIG. 4 ends.

Although certain example methods, apparatus and articles of manufacture have been described herein, the scope of coverage of this patent is not limited thereto. Such examples are intended to be non-limiting illustrative examples. On the contrary, this patent covers all methods, apparatus and articles of manufacture fairly falling within the scope of the appended claims either literally or under the doctrine of equivalents.

The Abstract included herewith is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An electrical terminal comprising:

a housing including a base portion and a top portion, wherein the base portion and the top portion are immovably affixed, the top portion having an opening defining an entry point for a wire to be terminated; and a first wire clamp positioned within the housing to secure the wire in electrical contact with a connector pin when the wire is extending into the housing through the opening, the connector pin extending out a bottom surface of the housing to be electrically connected to a printed circuit board, wherein the housing is to have one or more feet to separate the bottom surface of the housing from the printed circuit board.

2. The electrical terminal of claim 1, wherein the bottom surface of the housing is substantially sealed around the connector pin to substantially prevent at least one of contaminants, moisture or encapsulant from entering the housing.

3. The electrical terminal of claim 1, wherein the one or more feet are positioned adjacent the connector pin to reduce a possibility of an electrical leakage path developing between the connector pin and adjacent circuitry on an opposite side of the one or more feet when the connector pin is connected to the printed circuit board.

4. The electrical terminal of claim 1, wherein the base portion and the top portion are sealingly mated to substantially isolate the wire clamp within the housing from an outside environment adjacent the bottom surface and sides of the housing.

5. The electrical terminal of claim 1, further comprising a second wire clamp positioned within the housing adjacent the first wire clamp, wherein the base portion and the top portion form a wall separating the first and second wire clamps.

6. The electrical terminal of claim 1, wherein the top and base portions of the housing are sealed via at least one of ultrasonic welding, over-molding, an adhesive, or a sealant.

7. The electrical terminal of claim 1, wherein the electrical terminal is a cage clamp terminal.

8. The electrical terminal of claim 1, wherein the first wire clamp comprises a cage.

9. The electrical terminal of claim 8, further comprising a screw in the top portion of the housing to selectively move the cage to secure the wire.

10. An electrical terminal comprising:

a body having an opening to receive an end of a first wire, the body formed from a base portion and a separate top portion that are immovably affixed to each other, the top portion comprising the opening;

a first wire-holder within the body to secure the end of the first wire; and a first connector pin extending out a bottom surface of the body to be electrically connected to a circuit board, wherein the wire-holder is to secure the end of the wire in electrical connection with the connector pin, and wherein the body comprises a spacer extending out the bottom surface of the body adjacent the first connector pin to provide a space between the bottom surface of the body and the circuit board.

11. The electrical terminal of claim 10, wherein the bottom surface of the body is closed off to enable encapsulation of the circuit board without allowing encapsulant to enter the body.

12. The electrical terminal of claim 10, wherein the spacer is positioned between the connector pin and adjacent circuitry on the circuit board when the connector pin is connected to the circuit board.

13. The electrical terminal of claim 10, wherein the first wire-holder is sealingly enclosed within the body to reduce at least one of contaminants, encapsulants, or moisture entering the body.

14. The electrical terminal of claim 10, further comprising a second wire-holder within the body adjacent the first wire-holder to secure an end of a second wire in electrical connection with a second connector pin, the second connector pin extending out the bottom surface of the body adjacent the first connector pin.

15. The electrical terminal of claim 14, wherein the base and top portions form an internal wall between the first and second wire-holders.

16. The electrical terminal of claim 14, wherein the spacer is located between the first and second connector pins to reduce a development of an electrical leakage path between the first connector pin and the second connector pin.

17. The electrical terminal of claim 14, wherein the top and base portions of the body are sealed via at least one of ultrasonic welding, over-molding, an adhesive, or a sealant.

18. An electrical terminal comprising:

a housing having an opening to receive a first end of a first wire, the housing including a base portion and a separate top portion that are sealed together via at least one of ultrasonic welding, over-molding, an adhesive, or a sealant, the top portion comprising the opening;

a first connector pin extending out from a bottom surface of the housing via a hole in the bottom surface of the housing, the connector pin to connect to a circuit board via a solder joint;

a first clamp enclosed by the housing to secure the end of the wire in electrical contact with the first connector pin; and a riser extending from the bottom surface of the housing to raise the bottom surface of the housing away from the circuit board to enable access beneath the housing around the solder joint.

19. The electrical terminal of claim 18, wherein the hole in the bottom surface of the base portion is substantially fitted to the connector pin to reduce at least one of contaminants, moisture or encapsulant from entering the housing.

20. The electrical terminal of claim 18, wherein the housing has an internal wall to separate the first clamp enclosed by the housing from a second clamp enclosed by the housing, the second clamp to secure a second end of a second wire in electrical contact with a second connector pin.

21. The electrical terminal of claim 20, wherein the at least a portion of the riser is positioned between the first connector pin and the second connector pin.

* * * * *